US007281712B2

(12) United States Patent
Moffett, VI et al.

(10) Patent No.: US 7,281,712 B2
(45) **Date of Patent: *Oct. 16, 2007**

(54) GAMING DEVICE

(76) Inventors: Nicholas D. Moffett, VI, 1106 Elkhorn Peak La., Spearfish, SD (US) 57783; Emily S. Nelson, 721$^{1/2}$ 2$^{nd}$ Ave., Sioux Falls, SD (US) 57104

( * ) Notice: Subject to any disclaimer, the term of this patent is extended or adjusted under 35 U.S.C. 154(b) by 0 days.

This patent is subject to a terminal disclaimer.

(21) Appl. No.: 11/391,145

(22) Filed: Mar. 28, 2006

(65) Prior Publication Data

US 2006/0163805 A1 Jul. 27, 2006

Related U.S. Application Data

(63) Continuation of application No. 11/297,539, filed on Dec. 8, 2005, now Pat. No. 7,073,790, which is a continuation of application No. 10/800,966, filed on Mar. 16, 2004, now Pat. No. 7,070,183, which is a continuation-in-part of application No. 09/988,794, filed on Nov. 20, 2001, now abandoned.

(60) Provisional application No. 60/251,427, filed on Dec. 6, 2000.

(51) Int. Cl.
*A63F 7/02* (2006.01)

(52) U.S. Cl. ..... 273/118 R; 273/119 R; 273/138.1

(58) Field of Classification Search ..... 273/118 R, 273/118 A, 118 D, 119 R, 119 A, 121 R, 273/121 A, 138.1, 143 R, 108
See application file for complete search history.

(56) References Cited

U.S. PATENT DOCUMENTS 3,853,318 A 12/1974 Cagan
D251,515 S 4/1979 Richter et al.
D260,409 S 8/1981 Tanaka et al.
4,508,345 A 4/1985 Okada
4,518,098 A 5/1985 Fleischer
5,010,995 A 4/1991 Okada
D337,790 S 7/1993 Gottlieb et al.
5,342,049 A 8/1994 Wichinsky et al.
5,630,586 A 5/1997 Lowden
5,882,261 A * 3/1999 Adams ..... 463/20
5,997,400 A 12/1999 Seelig et al.
D419,201 S 1/2000 de Haas
6,047,963 A 4/2000 Pierce et al.
6,053,813 A 4/2000 Mathis
6,089,976 A 7/2000 Schneider et al.
6,089,978 A 7/2000 Adams (Continued)

FOREIGN PATENT DOCUMENTS

GB 2083936 A 3/1982

(Continued)

*Primary Examiner*—Raleigh W. Chiu
(74) *Attorney, Agent, or Firm*—Harness, Dickey & Pierce, P.L.C.; Brian G. Panka

(57) ABSTRACT

A gaming apparatus that is operable by a player in a slot mode and a pinball mode. In the slot mode the player operates a slot machine to display different combinations of symbols. In the pinball mode the player operates a pinball machine having a flipper and a play area to play a pinball game. The play area is oriented at an angle that is greater than zero degrees and less than ninety degrees above horizontal.

20 Claims, 3 Drawing Sheets

U.S. PATENT DOCUMENTS

| | | | | |
|---|---|---|---|---|
| 6,203,008 | B1 | 3/2001 | Krise et al. | |
| 6,709,332 | B2 * | 3/2004 | Adams | 463/20 |
| 7,070,183 | B2 * | 7/2006 | Moffett et al. | 273/118 R |
| 7,073,790 | B2 * | 7/2006 | Moffett et al. | 273/118 R |
| 2002/0066996 | A1 | 6/2002 | Nelson et al. | |

FOREIGN PATENT DOCUMENTS

| | | |
|---|---|---|
| GB | 2182186 A | 5/1987 |
| GB | 2201821 A | 9/1988 |

* cited by examiner

GAMING DEVICE

CROSS-REFERENCE TO RELATED APPLICATIONS

This application is a continuation application of pending U.S. patent application Ser. No. 11/297,539 entitled Gaming Device and filed Dec. 8, 2005, now U.S. Pat. No. 7,073,790 which is a continuation application of allowed U.S. patent application Ser. No. 10/800,966 entitled Gaming Device and filed Mar. 16, 2004 now U.S. Pat. No. 7,070,183. U.S. patent application Ser. No. 10/800,966 is a continuation-in-part of U.S. patent application Ser. No. 09/988,794, entitled Gaming Device and Method and filed Nov. 20, 2001, now abandoned. U.S patent application Ser. No. 09/988,794 claims the benefit of U.S. Prov. Pat. App. Ser. No. 60/251,427 entitled Gaming Device and filed Dec. 6, 2000, now expired. The entire disclosures of each of these applications are hereby incorporated by reference.

BACKGROUND OF THE INVENTION

The present invention generally relates to gaming devices. More specifically, the present invention is drawn to a pinball-slot machine combination.

"Gaming" or the participation of people in wagering games is probably as old as civilization and is worldwide in scope. In the last half of the twentieth century, the proliferation of casinos in the United States alone is evidence that games of chance are still enjoyed by large numbers of people. To maintain and enhance client interest, casino operators are always searching for new and interesting gaming formats. The present invention proposes a new and exciting game, which involves a merger of the widely popular pinball machine and slot machine games.

Variations of pinball gaming devices are shown in U.S. Design Pat. Ser. Nos. Des. 251,515 (Richter et al.), Des. 260,409 (Tanaka et al.), and Des. 337,790 (Gottlieb et al.). These patents merely show ornamental designs of pinball machines.

The most popular gaming device is probably the slot machine, variations of which are disclosed in U.S. Pat. No. 4,508,345 (Okada) and U.S. Pat. No. 5,010,995 (Okada), and in U.K. Patent Application Numbers GB 2,083,936A (Hurst et al.) and GB 2,182,186A (Thomas). These patents show variations of the popular slot machine gaming device.

U.S. Pat. No. 4,518,098 (Fleischer) shows a vending machine designed to appear as a slot machine. U.S. Pat. No. 3,853,318 (Cagan) discloses a combination dart and pinball device.

U.S. Pat. No. 5,630,586 (Lowden), U.S. Pat. No. 5,997,400 (Seelig et al.), U.S. Pat. No. 6,089,976 (Schneider et al.), and U.S. Pat. No. 6,089,978 (Adams), and U.K. Patent Application Number GB 2,201,821A (Pickardt et al.) each disclose combination gaming devices. However, none combine a pinball game and a slot machine game.

U.S. Pat. No. 5,882,261 (Adams) shows a gaming device that incorporates a vertical, pachinko style, pinball-type game with a slot machine. U.S. Pat. No. 5,342,049 (Wichinsky et al.) discloses a pinball-type game combined with a slot machine. These games do not offer interactive pinball play.

None of the above inventions and patents, taken either singly or in combination, are seen to disclose the invention as will subsequently be described and claimed in the instant invention.

SUMMARY OF THE INVENTION

Among the several objects and features of the present invention may be noted the provision of a gaming apparatus that combines a slot machine and a pinball machine.

In general, a gaming apparatus of the invention has a slot mode and a pinball mode. The apparatus comprises a slot machine capable of being activated by a player in the slot mode of the apparatus to display different combinations of symbols. The apparatus comprises a pinball machine operable in the pinball mode for the player to play a pinball game. The pinball machine includes a play area and a flipper. The play area of the pinball machine is oriented at an angle greater than zero degrees and less than ninety degrees above horizontal.

Other objects and features of the present invention will be in part apparent and in part pointed out hereinafter.

BRIEF DESCRIPTION OF THE DRAWINGS

Corresponding reference characters indicate corresponding parts throughout the views of the drawings.

DETAILED DESCRIPTION

Figure 1:
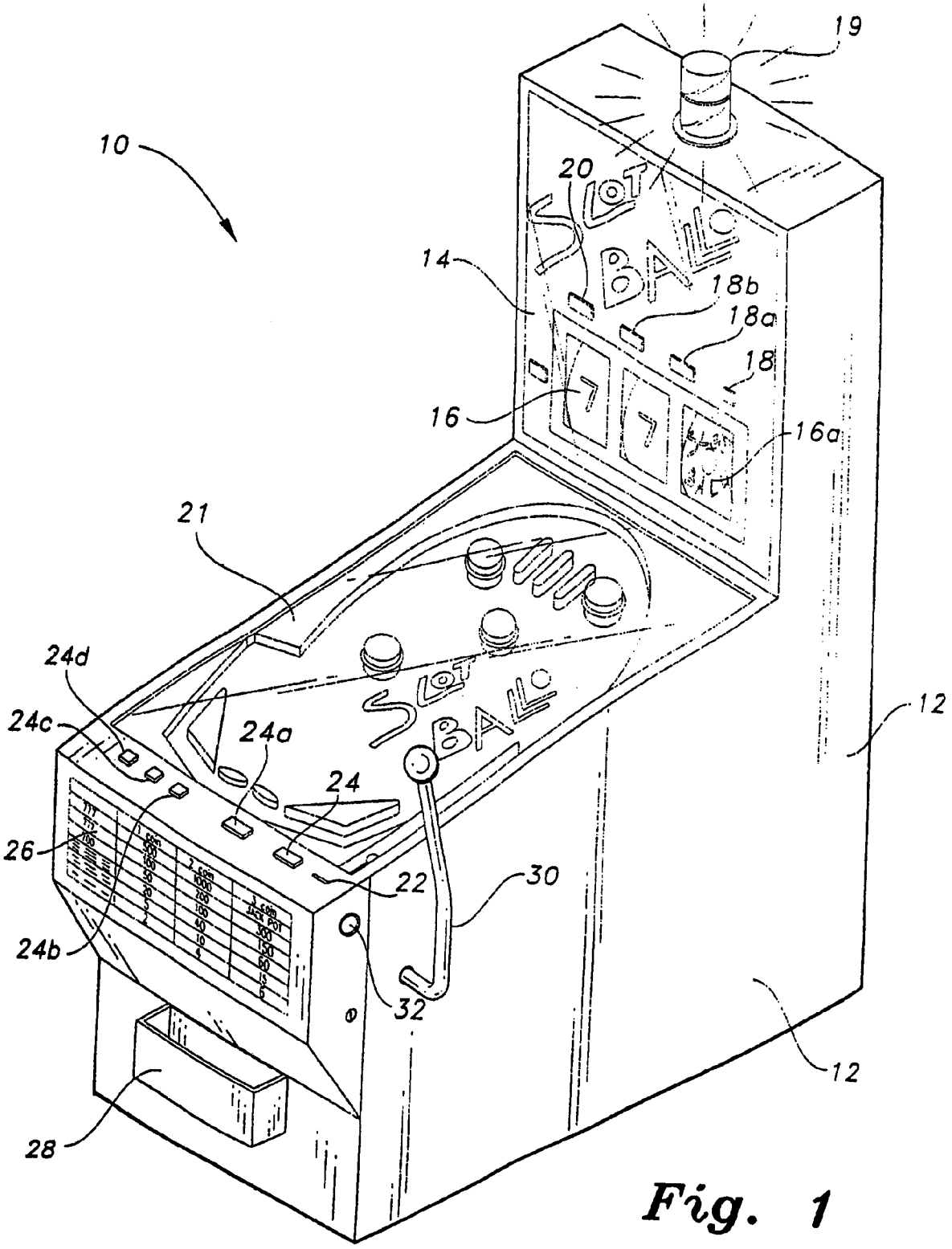
FIG. 1 is a perspective view of a gaming device according to the invention.
Figure 2:
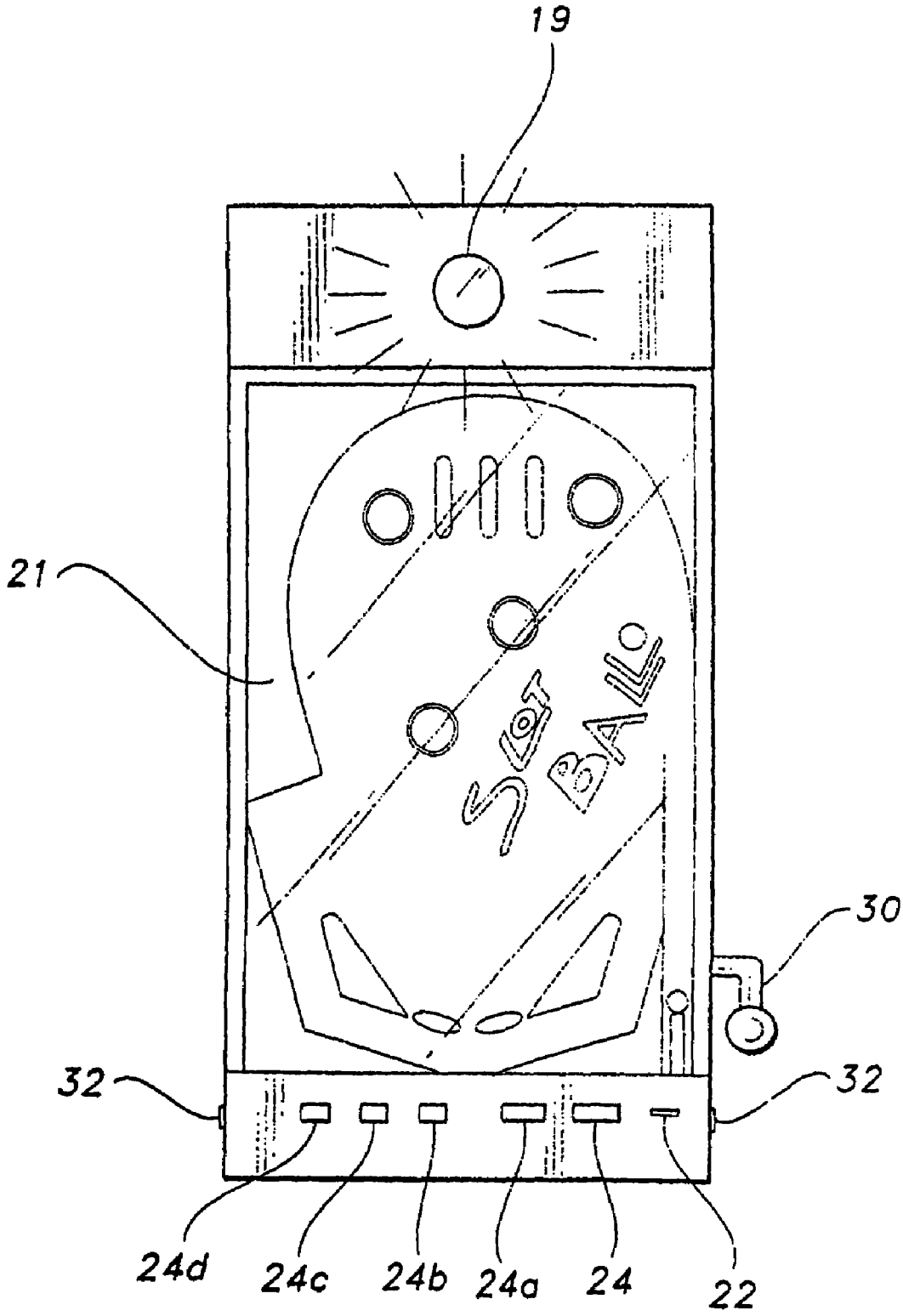
FIG. 2 is a top view of a gaming device according to the invention.
Figure 3:
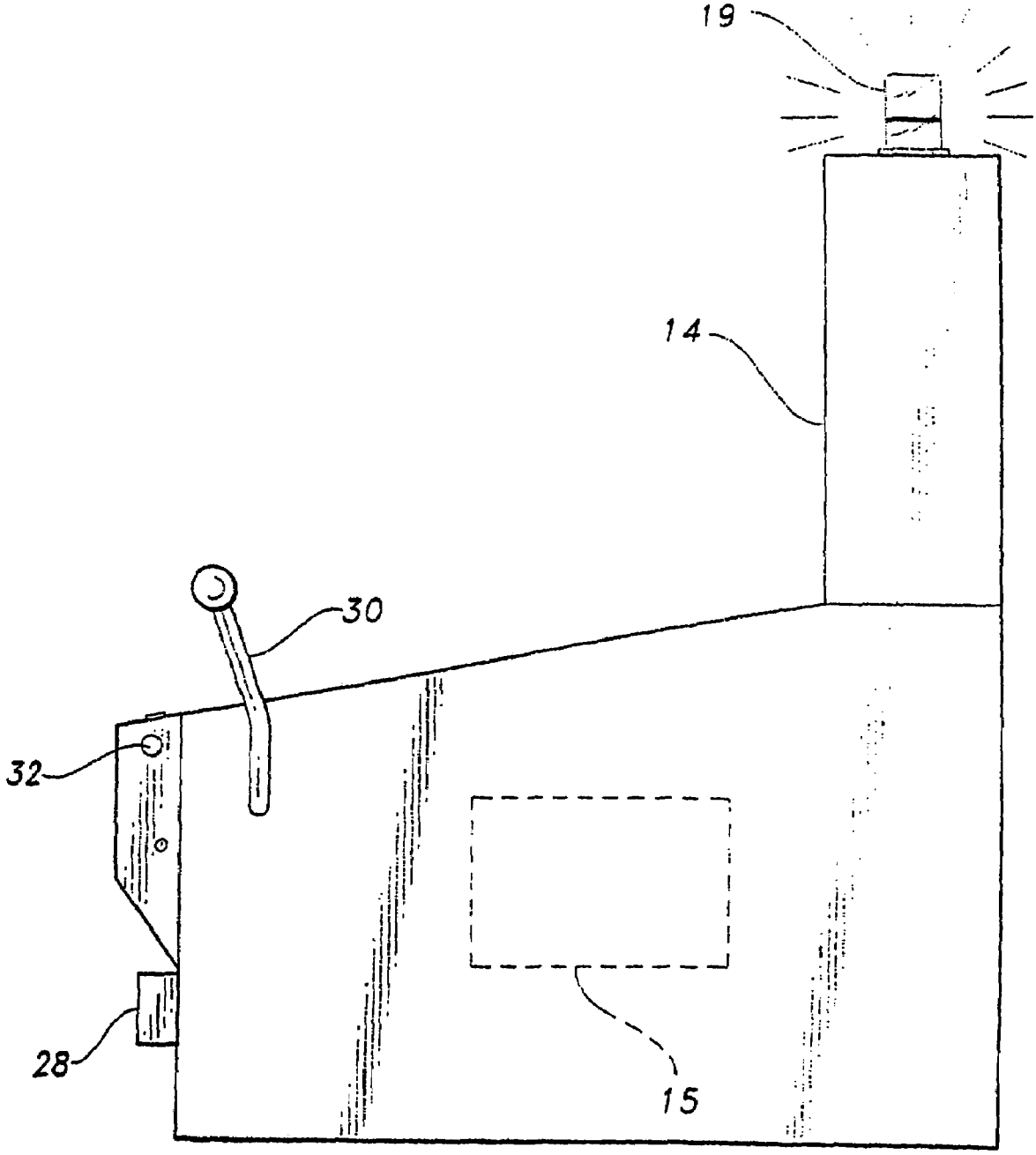
FIG. 3 is a side view of a gaming device according to the invention.

The gaming apparatus of the invention is generally indicated at 10 as illustrated in FIGS. 1-3. Apparatus 10 includes walls 12 which support and house conventional mechanical and electromechanical mechanisms 15 for operating a combination slot-pinball machine game. Walls 12 are designed to form a solid base to prevent the apparatus from being easily tilted. Although walls are illustrated as the support means, it is obvious that sturdy legs (or the like) could be utilized if desired.

The upper section 14 of the gaming apparatus is designed to appear and function as a conventional slot machine and includes slot reels 16 and indicator lights 18, 18*a*, 18*b*. Indicator 18 gives a reading for credits played; 18*a* indicates credits won in the pinball mode; 18*b* indicates total credits available. Indicator light 20 is the winner paid indicator. Slot reels 16 exhibit the standard pay line and slot icons (sevens, bars, cherries, etc.). The instant invention however, requires at least one reel to employ an icon with words, for example "slot ball," inscribed thereon as shown at 16*a*. A light 19 is adapted to flash to indicate either when a machine error occurs or when a player has hit the jackpot.

The lower section 21 of the apparatus is designed to appear and function as a pinball machine. Lower section 21 includes a control panel that incorporates the following functions. A coin slot 22 is provided for inserting coins or casino tokens to initiate the apparatus game mechanisms. Push button 24 is utilized to place a maximum credit bet. Push button 24*a* may be used to activate the slot reels. Button 24*b* is employed when a player wishes to input the amount of credits bet (from one to the maximum amount). Button 24*c* is used when a player decides to terminate play and wishes to cash out. Button 24*d* is a service button. For convenience, a pay scale 26 is inscribed on the front wall of the apparatus. A tray 28 for catching the player's winnings is positioned immediately beneath the pay scale. A handle 30 may be employed to activate the slot reels or launch the pinball when in pinball mode. Buttons 32 functions to move the pinball flippers (not shown) as is conventional in the art.

To initiate play, the player inserts coins or gaming tokens into coin slot 22. The player may bet any desired amount. However, the player cannot qualify for the slot jackpot and the "slot ball" bonus round if maximum credits are not bet. Handle 30, button 24 or button 24*a* is then manipulated to start slot reels 16. If the "slot ball" icon 16*a* appears on the pay line and the maximum amount of credits have been bet, the machine will automatically switch into the pinball mode. The player will then be able to win extra credits playing pinball. Once the pinball mode is activated, the machine will automatically place a pinball into the launch position. Handle 30 is employed to launch the pinball. As in ordinary pinball games, the player manipulates the pinball by pressing buttons 32, which buttons cause the flippers (not shown) to direct the pinball to strike credit adding or credit subtracting sensors. When the pinball goes out of play, the game reverts to the slot mode. The player has a choice of continuing to play by repeating the above process or to cash out.

In view of the above, it will be seen that the several objects of the invention are achieved and other advantageous results obtained.

When introducing elements of the invention, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions and methods without departing from the scope of the invention, it is intended that all matter contained in the above description and shown in the accompanying drawings shall be interpreted as illustrative and not in a limiting sense. It is also understood that the invention is not limited to the embodiments described above, but encompasses any and all embodiments within the scope of the following claims.

What is claimed is:

1. A gaming apparatus operable by a player and having a slot mode and a pinball mode, the apparatus comprising:

a slot machine capable of being activated by a player in the slot mode of the apparatus to display different combinations of symbols;

a pinball machine operable in the pinball mode for the player to play a pinball game, the pinball machine including a play area and a flipper, the pinball machine further including at least one credit adding sensor, at least one credit subtracting sensor, and a pinball credit score;

a pinball moveable within the play area by the flipper during operation of the pinball machine to interactively move the pinball into contact with the sensors within the play area to create the pinball credit score;

the play area of the pinball machine being oriented at an angle greater than zero degrees and less than ninety degrees above horizontal.

2. The gaming apparatus set forth in claim 1 wherein the play area of the pinball machine includes a substantially planar surface, the pinball rolling over the surface of the play area during operation of the pinball machine in the pinball mode, the flipper being operable in the pinball mode to keep the pinball in the play area.

3. The gaming apparatus set forth in claim 2 wherein the play area of the pinball machine is oriented at an angle greater than zero degrees and less than forty-five degrees above horizontal.

4. The gaming apparatus set forth in claim 1 further comprising an electromechanical mechanism for automatically switching between operation of the slot machine and operation of the pinball machine when the player allows the pinball to move out of the play area of the pinball machine.

5. The gaming apparatus set forth in claim 1 wherein the pinball machine includes two flippers and a plunger, the plunger being operable to move the pinball into the play area and the flippers being operated by the player to keep the pinball in the play area.

6. The gaming apparatus set forth in claim 5 wherein play of the pinball game begins when the plunger is activated to move the pinball into the play area.

7. The gaming apparatus set forth in claim 1 wherein the slot machine includes a slot credit score, the pinball credit score being added to the slot credit score when the gaming apparatus switches from operation of the pinball machine to operation of the slot machine.

8. The gaming apparatus set forth in claim 1 wherein the pinball credit score formed by engagement of the pinball with the credit sensors is zero or greater.

9. The gaming apparatus set forth in claim 1 wherein the pinball machine includes two flippers and a plunger, the plunger being operable to move the pinball into the play area and the flippers being operated by the player to keep the pinball in the play area.

10. The gaming apparatus set forth in claim 9 wherein play of the pinball game begins when the plunger is activated to move the pinball into the play area.

11. The gaming apparatus set forth in claim 1 wherein the pinball machine includes two flippers and a launcher, the launcher moving the pinball into the play area and the flippers moving the pinball around the play area.

12. The gaming apparatus set forth in claim 11 wherein the launcher comprises a plunger.

13. A gaming apparatus operable by a player and having a slot mode and a pinball mode, the apparatus comprising:

a slot machine capable of being activated by a player in the slot mode of the apparatus to display different combinations of symbols;

a pinball machine operable in the pinball mode for the player to play a pinball game, the pinball machine including a play area and a flipper;

a pinball movable around the play area by operation of the flipper;

an electromechanical mechanism for automatically switching between operation of the slot machine and operation of the pinball machine when the player allows the pinball to move out of the play area of the pinball machine;

the play area of the pinball machine being oriented at an angle greater than zero degrees and less than ninety degrees above horizontal.

14. The gaming apparatus set forth in claim 13 wherein operation of the flipper acts to keep the pinball in play to continue operation of the apparatus in the pinball mode.

15. The gaming apparatus set forth in claim 14 wherein the electromechanical mechanism switches from operation of the pinball machine to operation of the slot machine when the pinball moves past the flipper and out of the play area.

16. The gaming apparatus set forth in claim 15 wherein the pinball machine includes two flippers and a plunger, the plunger being operable to move the pinball into the play area and the flippers being operated by the player to keep the pinball in the play area.

17. A gaming apparatus operable by a player and having a slot mode and a pinball mode, the apparatus comprising:

a slot machine capable of being activated by a player in the slot mode of the apparatus to display different combinations of symbols, the slot machine including a slot credit score;

a pinball machine operable in the pinball mode for the player to play a pinball game, the pinball machine including a play area, a flipper, at least one credit adding sensor, at least one credit subtracting sensor, and a pinball credit score;

a pinball moveable within the play area by the flipper during operation of the pinball machine to interactively move the pinball into contact with the sensors within the play area to create the pinball credit score;

the pinball credit score being added to the slot credit score when the gaming apparatus switches from operation of the pinball machine to operation of the slot machine.

18. The gaming apparatus set forth in claim 17 wherein the pinball credit score formed by engagement of the pinball with the credit sensors is zero or greater.

19. The gaming apparatus set forth in claim 18 wherein the electromechanical mechanism switches from operation of the pinball machine to operation of the slot machine when the pinball moves past the flipper and out of the play area.

20. The gaming apparatus set forth in claim 19 wherein the pinball machine includes two flippers and a plunger, the plunger being operable to move the pinball into the play area and the flippers being operated by the player to keep the pinball in the play area.

* * * * *